United States Patent [19]

Sproch et al.

[11] Patent Number: 4,719,456

[45] Date of Patent: Jan. 12, 1988

[54] VIDEO DOT INTENSITY BALANCER

[75] Inventors: James D. Sproch, Rocky Point; Morton B. Herman, Huntington, both of N.Y.

[73] Assignee: Standard Microsystems Corporation, Hauppauge, N.Y.

[21] Appl. No.: 709,438

[22] Filed: Mar. 8, 1985

[51] Int. Cl.[4] ..... G09G 1/16

[52] U.S. Cl. ..... 340/728; 340/748; 340/735; 340/790

[58] Field of Search ..... 340/721, 744, 745, 748, 340/747, 789, 790, 792, 800, 801, 803, 728, 750, 735

[56] References Cited

U.S. PATENT DOCUMENTS

| | | | |
|---|---|---|---|
| 4,040,088 | 8/1977 | Hannan | 340/728 |
| 4,053,878 | 10/1977 | Cannon | 340/750 |
| 4,079,367 | 3/1978 | Yonezawa et al. | 340/803 X |
| 4,149,149 | 4/1929 | Miki et al. | 340/803 X |
| 4,149,150 | 4/1979 | Miyakaw et al. | 340/803 X |
| 4,208,723 | 6/1980 | Lecklider | 340/728 X |
| 4,212,008 | 7/1980 | Hopkins, Jr. | 340/728 |
| 4,212,009 | 7/1980 | Adleman et al. | 340/728 |
| 4,318,097 | 3/1982 | Oura | 340/728 |
| 4,345,244 | 8/1982 | Greer et al. | 340/728 |
| 4,584,572 | 4/1986 | Lambert, III | 340/728 X |

*Primary Examiner*—Gerald L. Brigance

*Attorney, Agent, or Firm*—Hopgood, Calimafde, Kalil, Blaustein & Judlowe

[57] ABSTRACT

A video dot intensity balancer for use in a video display system wherein information is represented by a series of logic bits in a video stream corresponding to dots to be displayed on a CRT is disclosed. Logic elements are coupled to the output of a bit generator for comparing adjacent bits and outputting an information-defining signal wherein a single information-defining bit never stands alone. In this manner, apparent intensity imbalances on the video screen are eliminated.

6 Claims, 1 Drawing Figure

VIDEO DOT INTENSITY BALANCER

TECHNICAL FIELD

The present invention relates to video attributes controllers used to process digital signals before applying them to a display. More specifically, the invention relates to a method and apparatus for processing digitally coded text and graphics information before it is applied to a cathode ray tube video monitor ("CRT") so as to enhance the uniformity of the display.

BACKGROUND OF THE INVENTION

Cathode ray tubes (CRT's), similar to those used to display television images, are commonly used to display both text and graphics information derived from such sources as computers, videotext sources, computer data bases and the like. Such systems offer a cost effective and high-resolution means for displaying information. The information displayed in such applications is usually derived from a digital signal representing the information to be displayed on the CRT. For example, a logic "1" bit commonly corresponds to a bright dot and a logic "0" bit will produce no reaction from the screen. This contrasts with the use of CRTs in a classical television system wherein the signal representing the displayed information is derived from an analog signal source. Nevertheless, the signal that ultimately drives the CRT in both applications is an analog one.

The image drawn on the CRT display is produced by an electron beam striking the back of a transparent glass screen coated with a flourescent material that emits light in response to being excited by the electron beam. The intensity of the displayed image is controlled by the intensity of the electron beam striking the flourescent screen.

The image displayed on a conventional raster scan CRT is made up of a series of frames each lasting about 1/30th of a second. Each frame is commonly made up of two fields lasting about 1/60th of a second. The fields are made up of a number of scan lines (typically 262.5, the NTSC standard employed in the United States for commercial television). The display is further adapted to interlace the scan line of each field so that a complete frame comprising two fields is made up of 525 scan lines. The number of scan lines determines the vertical resolution of the display.

Although the foregoing description applies to a typical NTSC television display, the same principles are generally applicable to a CRT display used in a computer application. In such a system the number of scan lines and the interlacing process may be modified, but the general principal of sequential display of scan lines comprising successive frames remains the same. The horizontal display resolution of the CRT is a function of the speed at which the electron beam scanning the screen can be modulated by the system.

A common way of displaying text information on a CRT is to define each text symbol as comprising a grid of display dots. Typically, modern systems define a text character within a 5×7, 7×9, or 12×16 dot matrix or character cell. When a character is to be displayed on a CRT, the dots representing the text symbol in the vertical direction are represented on successive horizontal scan lines. In the horizontal direction, the dots are displayed by turning the electron beam on and off as it traverses the screen. For example, if a text or graphical symbol is represented in a cell comprising 5×7dots there will be thirty-five possible dots that may or may not be illuminated according to the appropriate symbol to be displayed. If, for example, the symbol T is to be displayed, the first scan line at the location at which the T is to be shown on the CRT will be active for a duration corresponding to five dots, thereby displaying the top portion of the T. During the next successive six scan lines the beam will only be active for a duration corresponding to one dot location thereby drawing out the vertical portion, or "stem" of the T.

The fact that the vertical portion of the T is made up of single dots standing alone in the video stream often leads to an apparent intensity imbalance, as discussed in more detail hereinafter. There are considerable demands made on a CRT display system when it is required to display a number of symbols per line. These demands can best be illustrated by considering the requirement of a typical computer terminal used to display either text or graphics symbols. As before, assume each symbol consists of a matrix of 5×7dots. A typical CRT system is required to display eighty such characters per line (in the previous sentence, a "line" refers to a line of character which is comprised of, in the example, 7 horizontal scan lines of the beam). Eighty characters will require the possibility of at least 400 (80×5) dot locations in the horizontal direction. In order for the CRT to accurately display such dots it is necessary for it to be capable of turning on and off more than 400 times per scan line, because there are extra bits or "backfill" between characters.

In a typical display system each scan line may take roughly 63 microseconds, of which about 55 microseconds are available for displaying information. The extra 8 microseconds are required to allow the beam to return to its starting position on the next line. For a beam to be capable of turning on and off 400 times in 55 microseconds, a video monitor bandwidth of about 7 megahertz is required. That is, the beam must be capable of turning on and off 7 million times per second. The horizontal bandwidth of a typical commercial television is only about 3.8 MHz, making it unsuitable for high information density video applications.

When a video monitor lacks the required bandwidth, the resolution and hence the clarity of the display will be compromised. Returning to the example of the "T", the top portion will be relatively bright even if the video monitor's bandwidth is relatively low. This is so because the beam drawing the top portion remains on as it traverses the character cell. The response time of the video monitor is thus not particularly critical. However, during successive scan lines, when the "stem", or lower portion, of the T is to be drawn, the beam is only on for 1 dot period. Therefore, if the video monitor lacks sufficient bandwidth, the stem will be only dimly displayed, if displayed at all. This leads to an apparent intensity imbalance between portions of the same character and between different characters on the screen.

The intensity imbalance problem can be alleviated using video monitors with sufficient bandwith, for instance a video monitor with a 12 MHz bandwidth would be suitable in many applications. As the resolution required increases, as would be the case with more characters or higher dot density per character cell, the bandwidth required also increases. Video monitors with high bandwidths and short rise times are very expensive and are therefore not a practical solution in many cases. For example, a video monitor with a 15 MHz bandwidth and a video amplifier rise and fall time of 20 ns costs roughly $100, whereas a video monitor with an 80 MHz bandwidth and a video amplifier with a 4.5 ns video amplifier rise and fall time may cost in excess of $1,000.

It is accordingly an object of the invention to provide a cost effective means to balance the apparent intensity between horizontal and vertical line segments on a video screen.

Another object of the invention is to provide for selective intensity balancing of a video display.

A further object of the invention is to provide for video intensity balancing in both normal and reverse video modes of operation.

Still further objects and advantages of the invention not specifically enumerated here will become readily apparent upon consideration of the following drawing, description and claims.

SUMMARY OF THE INVENTION

The present invention solves the problem of providing a uniform video display of information in a digital CRT system wherein information to be displayed is represented by a series of logic bits by logically operating on the logic bits so that a single video dot never stands alone. Thus, even a video monitor of relatively low bandwidth can adequately respond to a high information density signal.

In a particular embodiment of the invention, there is provided a character generator for generating a plurality of character matrix bits coupled to logical means. The logical means perform a logical OR operation between a given character matrix bit and the preceding adjacent character matrix bit on the same scan line of the electron beam. In this way, a single video dot corresponding to the bits never stands alone in the video stream.

Further refinements of the invention include logically operating on the data by way of an EXCLUSIVE OR operation to provide inverse video. In this case, the character-defining bits are logical "0"s which also never stand alone in the video stream in accordance with the invention. Both the EXCLUSIVE OR and OR operations may be enabled on a character by character basis, allowing for system flexibility.

BRIEF DESCRIPTION OF THE DRAWING

The present invention is described in detail below with reference to the drawing. The single figure is a block diagram of a video dot intensity balancer constructed in accordance with the invention.

DETAILED DESCRIPTION

Figure 1:
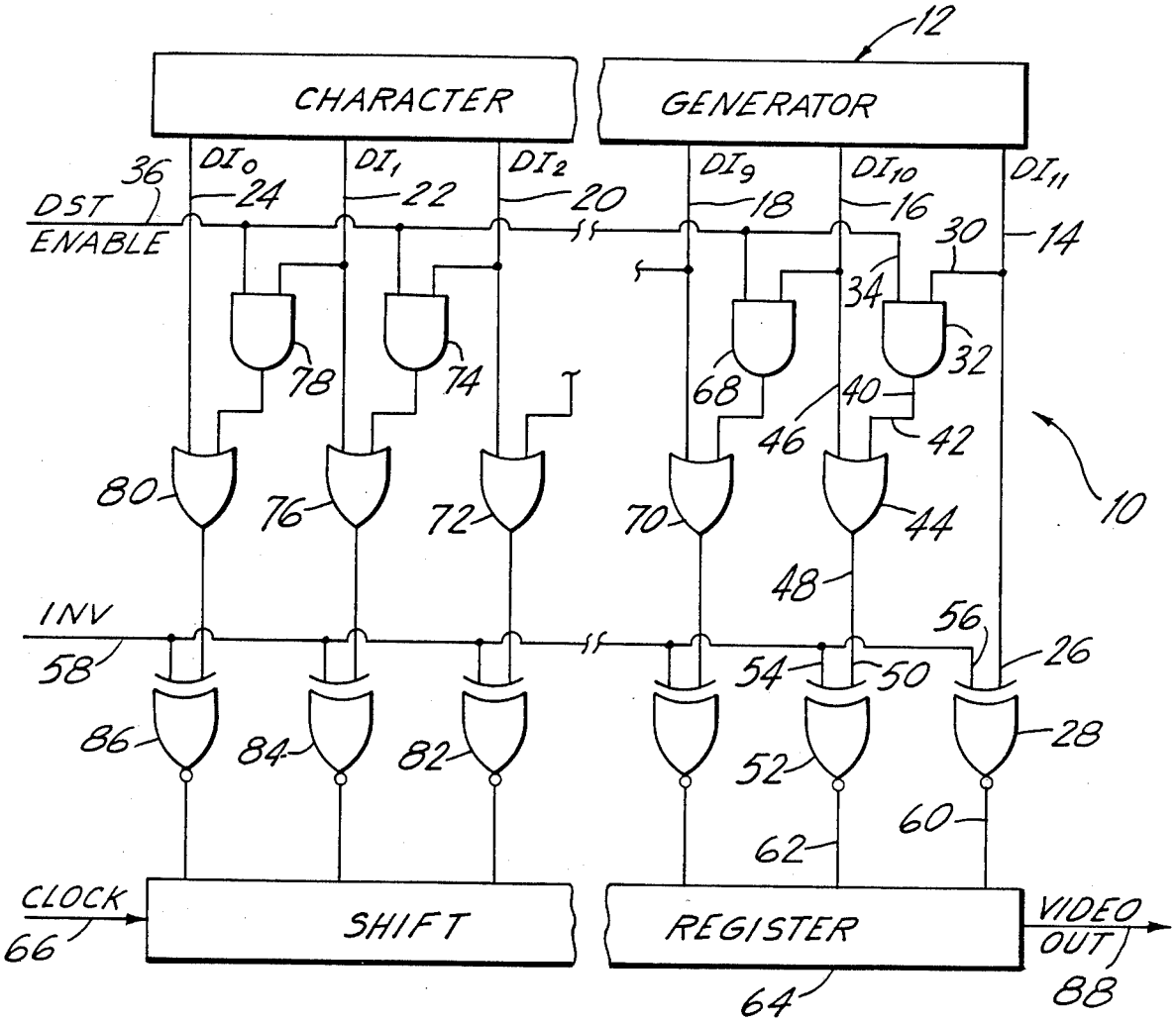

In the examples described hereinafter it will be understood that the information to be displayed on a video screen is represented by a series of bits which ultimately define a plurality of video dots arranged on a CRT. A logic "1" defines a white dot produced by the electron beam and a logic "0" defines background or dark screen. In reverse video, the logic "0"s are the information-defining bits, whereas in normal video the logic "1"s are the information defining bits. In the embodiment of the invention specifically illustrated, an information cell is 12 bits wide and for purposes of brevity the invention is discussed in connection with a single line of an individual character cell. Three types of logic gates are used in the inventive apparatus 10 shown in the figure: AND gates, OR gates and EXCLUSIVE OR gates. All three logical elements and methods of fabricating them are well known.

Referring now specifically to the figure, there is shown a video dot intensity balancer 10 including a character generator 12 defining a plurality of outputs 14 through 24. In the examples set forth hereinbelow, a character cell is 12 bits wide (i.e. $DI_{11}$–$DI_0$all have separate output lines from character generator 12), it being understood that the circuitry associated with bits $DI_8$–$DI_3$ is identical as that shown, for example, in connection with bit $DI_{10}$.

Line 14, the line carrying the first bit to be output by device 10, is connected to an input 26 of EXCLUSIVE OR gate 28. Line 14 is also connected to an input 30 of an AND gate 32. Another input 34 of AND gate 32 is connected to a logic enabling line 36. Output 40 of AND gate 32 is applied to an input 42 of OR gate 44.

The other input 46 of OR gate 44 is received from line 16. Output 48 of OR gate 44 is applied to an input 50 of another EXCLUSIVE OR gate 52. Both EXCLUSIVE OR gate 28 and gate 52 have an input 54 and 56 respectively connected to inverse video enabling line 58. The outputs 60 and 62 of the EXCLUSIVE OR gates are applied to a 12 bit shift register 64, which is clocked via line 66.

As can be seen from the figure, data lines 18 through 24 and logic gates 68 through 86 are connected in the same manner as described hereinabove in connection with line 16 and gates 32, 44 and 52. That is, each bit output over lines 14 through 24 ultimately is stored in the shift register 64.

When it is desired to operate on a digital video signal from the character generator, a logic 1 is applied to line 36 so that each AND gate 32, 68, 74 and 78 has a logic 1 applied to one of its inputs. When data bits (such as data bits $DI_{11}$–$DI_0$) are output substantially simultaneously, that is, in parallel, by character generator 12 over the data lines, all of the bits, with the exception of the first bit $DI_{11}$ will thus be logically ORed with the previous bit. The $DI_{11}$ bit is stored in the shift register regardless of the last bit in the preceding character cell. The other bits derived from bits $DI_{10}$–$DI_0$ are also stored in the shift register 64.

The bits stored in the shift register are clocked onto output line 88 in serial fashion for display on a video monitor. It should be understood that the serial data signal on line 88 may be further modified if so desired so that the video stream eventually applied to a monitor may contain additional bits.

When it is desired to operate the inventive system in a reverse video mode, a logic 1 is applied to line 58. As should be clear, this has the effect of logically inverting the outputs of OR gates 44, 70, 72, 76 and 80, as well as logically inverting bit $DI_{11}$, That is to say, a 0 becomes a 1 and vice-versa.

After all 12 outut bits ($D_{11}$–$D_0$) are clocked out of the shift register, the next 12 bits from which another line of another character cell are output from generator 12 and the process is repeated.

The following examples will provide further illustration of the inventive video dot intensity balancer.

EXAMPLE I

Consider the case where a character cell for display is 12 bits wide and line 36 carries a logic 1, and line 58 is held at logic 0. When the parallel information pattern from the character generator is as follows:

($DI_{11}$–$DI_0$) 100101100100 the serial output or information defining signal from shift register 64 contains the bits $(D_{11}-D_0)$ 11011110110

Thus, the information-defining bits (1s in normal video) will never stand alone in the video stream, that is, all of the single information-defining bits are doubled so that the corresponding dots appearing on the video screen are "stretched".

EXAMPLE II

Consider the case where both lines 36 and 58 carry a logic 1 signal and the following data bits are output from the character generator:

$(DI_{11}-DI_0)$ 010011001000

The reverse video pattern would be:

101100110111

However, with dot stretching the output bit pattern from the shift register is then:

$(D_{11}-D_0)$ 100100010011

Here again, it can be seen that the information-defining bits, 0s in this case, never stand alone.

By way of summary of the foregoing description and examples, the inventive video dot intensity balancer logically operates on display information by comparing the display bits provided by a character generator in parallel with the adjacent bits to produce information-defining bits according to the logical formula:

$$D_k=(DI_k+DI_{K+1}\cdot D_{STenb}) \otimes (\text{Inv})$$

where k =an integer corresponding to the number of dots across a display cell of a video display system;

$D_k$=the $k_{th}$ bit output by the logical means of the video dot intensity balancer;

$DI_k$=the $k_{th}$ bit provided to the respective data lines by the character generator;

$DI_{K+1}$=the bit provided to the data lines immediately proceeding the $DI_k$ bit (note that $DI_{k+1}=0$ for the first bit $DI_{11}$);

$D_{STenb}$=The signal on the enabling line 36;

Inv =the signal on the inverse line 58 and;

+, ·, ⊗ indicate a logical OR, a logical AND, and a logical EXCLUSIVE OR operation respectively.

After the bits from the character generator are operated on, the bits thus produced are stored in a shift register and output in a serial fashion for display. Thus, the inventive video dot intensity balancer satisfies the objects of the instant invention in that it provides a cost-effective solution to the problem of apparent intensity differences produced on a video display by ensuring that a single dot never stands alone in the video stream. Moreover, dot stretching can be selected on a line-by-line or character-by-character basis by providing an enabling signal to line 36 and the device operates in substantially the same way in reverse video.

Although the invention has been described in detail in connection with a single embodiment, various modifications will be readily apparent to those of ordinary skill in the art. Such modifications are within the spirit and scope of the invention which is limited and defined only by the appended claims.

What is claimed is:

1. In a digital video display system wherein information is represented by a series of logic bits in a video stream corresponding to dots to be displayed on a CRT, a video dot intensity balancer comprising means for generating a plurality of logic bits and defining an output on N output lines, wherein N is an integer greater than 1 and a plurality of logic means respectively coupled to said N ouput lines of said bit generating means for comparing adjacent logic bits and outputting an information-defining signal in response thereto, said information-defining signal comprising a plurality of information-defining logic bits, said logic means including an OR gate, one input of which is connected to a first one of said N lines and the other input of which is connected to the ouptut of an AND gate, the inputs of said AND gate connected to a dot stretching enabling line and to an adjacent second of said N lines, the logic bit on said first line being logically ORed with the logic bit on said second adjacent line when there is an enabling signal on said enabling line, whereby each of said information-defining logic bits of a preselected logic value are adjacent at least one bit of identical logic value in said video stream.

2. The video dot intensity balancer according to claim 1, wherein said logic means defines N outputs, and further comprising an N bit shift register means coupled to said N outputs of said logic means for providing a serial video ouput.

3. The video dot intensity balancer according to claim 2, wherein said logic means further comprises at least one EXCLUSIVE OR gate having one input coupled to the output of said OR gate and a second input coupled to an inverse enabling line.

4. The video dot intensity balancer according to claim 1, wherein said logic means operates on said logic bits generated by said bit generating means according to the logic formula:

$$D_k=(DI_k+DI_{k+1}\cdot DSTenb)$$

where k =an integer corresponding to the dots in a display cell of a video display system; $D_k$=The $k_{th}$ bit ouput by said video dot intensity balancer; $DI_k$=the $k_{th}$ bit output by said character generating means; $DI_{k+1}$=The bit adjacent the $DI_k$ bit and equal to 0 for the first bit output by said bit generating means for a given display cell; DSTenb =a dot stretching enabling logical signal; +=a logical OR operation; and ·=a logical AND operation, to provide said information-defining bits.

5. In a digital video display system wherein information is represented by a series of logic bits in a video stream corresponding to dots to be displayed on a CRT, a method of dot stretching comprising the steps of:

providing a plurality of input logic bits corresponding to information to be displayed on a video screen in a parallel fashion to a logical means;

at said logical means, inputting a first logic bit to a first input of a logic AND gate, applying a dot stretching enabling signal to a second input of said logic AND gate, applying the output of said logic AND gate to one input of a logic OR gate, and inputting a second adjacent logic bit to a second input of said logic OR gate, to produce information-defining bits according to the logical formula $D_k=(DI_k+DI_{k+1}\cdot DSTenb)$ where k=an integer corresponding to the dots in a display cell of said video display system; $D_k$=the $k_{th}$ bit output by the logical means; $DI_k$=the $k_{th}$ bit provided to said logic means; $DI_{k+1}$=the bit adjacent the $DI_k$ bit and equal to 0 for the first input bit of a character cell; DSTenb=a dot stretching enabling logical signal; +=a logical OR operator; ·=a logical AND operator; and outputting said information defining-bits produced by said logical means therefrom in serial fashion.

6. The method according to claim 5, further comprising the step of inverting said information-defining bits.

* * * * *